US008023674B2

(12) United States Patent
Schumaier et al.

(10) Patent No.: US 8,023,674 B2
(45) Date of Patent: Sep. 20, 2011

(54) CONNECTOR FOR HEARING ASSISTANCE DEVICE HAVING REDUCED MECHANICAL FEEDBACK

(75) Inventors: Daniel R. Schumaier, Elizabethton, TN (US); David M. Campbell, II, Johnson City, TN (US)

(73) Assignee: Daniel R. Schumaier, Elizabethton, TN (US)

( * ) Notice: Subject to any disclaimer, the term of this patent is extended or adjusted under 35 U.S.C. 154(b) by 391 days.

(21) Appl. No.: 12/431,824

(22) Filed: Apr. 29, 2009

(65) Prior Publication Data

US 2010/0067725 A1 Mar. 18, 2010

Related U.S. Application Data

(63) Continuation-in-part of application No. 12/212,415, filed on Sep. 17, 2008.

(51) Int. Cl.
*H04R 25/00* (2006.01)

(52) U.S. Cl. ..... 381/324; 381/312; 381/330

(58) Field of Classification Search ..... 381/312, 381/322, 323, 324, 330; 600/25; 607/55, 607/57

See application file for complete search history.

(56) References Cited

U.S. PATENT DOCUMENTS

| | | | |
|---|---|---|---|
| 5,606,621 A | 2/1997 | Reiter et al. | |
| 6,106,488 A | 8/2000 | Fleming et al. | |
| 6,219,433 B1 | 4/2001 | Okuzawa et al. | |
| 6,643,378 B2 | 11/2003 | Schumaier | |
| 6,695,943 B2 | 2/2004 | Juneau et al. | |
| 6,728,387 B1 | 4/2004 | Polito et al. | |
| 6,922,477 B1 | 7/2005 | Ikeyama | |
| 6,940,988 B1 | 9/2005 | Shennib et al. | |
| 7,016,512 B1 * | 3/2006 | Feeley et al. | 381/324 |
| 7,020,298 B1 | 3/2006 | Tziviskos et al. | |

(Continued)

FOREIGN PATENT DOCUMENTS

WO 2005007049 1/2005

*Primary Examiner* — Brian Ensey

(74) *Attorney, Agent, or Firm* — Luedeka, Neely & Graham, P.C.

(57) ABSTRACT

An electronic hearing aid apparatus comprises a first component, a second component and a cable assembly for electrically connecting the first component to the second component. The first component includes a vibration sensor generating a vibration signal based on sensed acoustic vibrations, electronics for processing and amplifying the vibration signal and an output port for providing access to the amplified vibration signal. The second component includes an input port for receiving the amplified vibration signal and a vibration generator for generating vibrations based on the amplified vibration signal. The cable assembly conducts the amplified vibration signal from the output port of the first component to the input port of the second component. The cable assembly includes a first connector for connecting to the first component, a second connector for connecting to the second component and a flexible cable portion for electrically connecting the first connector to the second connector. The first and second connectors each comprise an inner connector housing and an outer connector shell. The inner connector housing includes a rear cavity in which solder joints are disposed that provide electrical connection between the connector's contacts and the wires of the flexible cable portion. Potting material encases the solder joints within the rear cavity. The outer connector shell, which may be over-molded onto the inner connector housing in an injection molding process, encloses most of the inner connector housing and a portion of the flexible cable where the flexible cable connects to the inner connector housing.

15 Claims, 8 Drawing Sheets

U.S. PATENT DOCUMENTS 7,076,076 B2 7/2006 Bauman
7,106,873 B1 * 9/2006 Harrison et al. ..... 381/330
2006/0056649 A1 3/2006 Schumaier
2006/0256991 A1 11/2006 Oxford

* cited by examiner

View BB

View AA

CONNECTOR FOR HEARING ASSISTANCE DEVICE HAVING REDUCED MECHANICAL FEEDBACK

This continuation-in-part application claims priority to currently pending U.S. patent application Ser. No. 12/212,415 titled "Hearing Assistance Device Having Reduced Mechanical Feedback" filed Sep. 17, 2008, the entire contents of which are incorporated herein by reference.

FIELD

The present invention relates generally to hearing aids. More particularly, the present invention relates to an apparatus for reducing mechanical feedback between an in-the-ear (ITE) component and a behind-the-ear (BTE) component of a hearing assistance device.

BACKGROUND

For many hearing loss patients, bone conduction hearing aids offer a better solution than more conventional acoustic/air transmitting hearing aids. Indeed, for some patients, bone conduction hearing aids offer the only solution. Bone conduction hearing assistance generally involves vibration of the patient's mastoid bone to improve hearing perception. In a typical bone conduction hearing aid, sound sensed by a microphone is converted to an electrical signal and amplified. The amplified signal is then received by a small vibrator which vibrates the mastoid bone.

Strategic placement of the vibrator on the user is essential in order to achieve optimal results. For example, some bone conduction hearing aids teach that the vibrator should be placed against the skin behind the ear, while others teach placing the vibrator on the forehead. Still others teach surgical implantation of the vibrator directly into the mastoid bone for better transmission of vibration. One particularly effective approach has been to mount the vibrator on an ITE structural member. The structural member is inserted in the patient's ear canal so that the vibrator is positioned adjacent the mastoid bone.

In prior hearing aids, a relatively stiff electrical cable connected the ITE component containing the vibrator to a BTE component containing a microphone and processing electronics. The stiff interconnecting cable of prior units provided a pathway for vibrations from the vibrator to the microphone. These vibrations caused undesired feedback or "ringing" which is irritating to the patient.

What is needed, therefore, is an apparatus that reduces mechanical feedback between the ITE component and the BTE component of a hearing aid device.

SUMMARY

The above and other needs are met by an electronic hearing aid apparatus comprising a first component, a second component and a cable assembly for electrically connecting the first component to the second component. The first component includes a vibration sensor for sensing acoustic vibrations and generating a vibration signal based on the sensed acoustic vibrations, electronics for processing and amplifying the vibration signal to generate an amplified vibration signal, and an output port for providing access to the amplified vibration signal. The second component includes an input port for receiving the amplified vibration signal and a vibration generator for generating vibrations based on the amplified vibration signal. The cable assembly conducts the amplified vibration signal from the output port of the first component to the input port of the second component. The cable assembly includes a first connector for electrically connecting to the output port of the first component, a second connector for electrically connecting to the input port of the second component and a flexible cable portion for electrically connecting the first connector to the second connector. In some embodiments, the first component of the hearing aid apparatus is contained in a housing configured to be worn behind the ear of a user. In some embodiments, the second component is contained in a housing configured to be worn in the ear of the user.

The first and second connectors of the cable assembly each include an inner connector housing and an outer connector shell. The inner connector housing includes a rear cavity in which solder joints are disposed. These solder joints provide electrical connection between the connector's contacts and the wires of the flexible cable portion. Also disposed in the rear cavity of the inner connector housing is potting material that encases the solder joints. The outer connector shell, which is preferably over-molded onto the inner connector housing in an injection molding process, encloses most of the inner connector housing and a portion of the flexible cable where the flexible cable connects to the inner connector housing.

In some preferred embodiments, the inner connector housing includes retention features on its outer surface which prevent the outer connector shell from slipping with respect to the inner connector housing when a pulling force is applied to the outer connector shell. These retention features may include a retention pin and stepped features in the outer surface of the inner connector housing.

Some preferred embodiments also include grip features molded into the outer surface of the outer connector shell. These grip features make it easier for a user to grasp and pull the connector when disconnecting the connector from the first or second component of the hearing aid apparatus.

BRIEF DESCRIPTION OF THE DRAWINGS

Further advantages of the invention are apparent by reference to the detailed description in conjunction with the figures, wherein elements are not to scale so as to more clearly show the details, wherein like reference numbers indicate like elements throughout the several views, and wherein.

DETAILED DESCRIPTION

Figure 1:
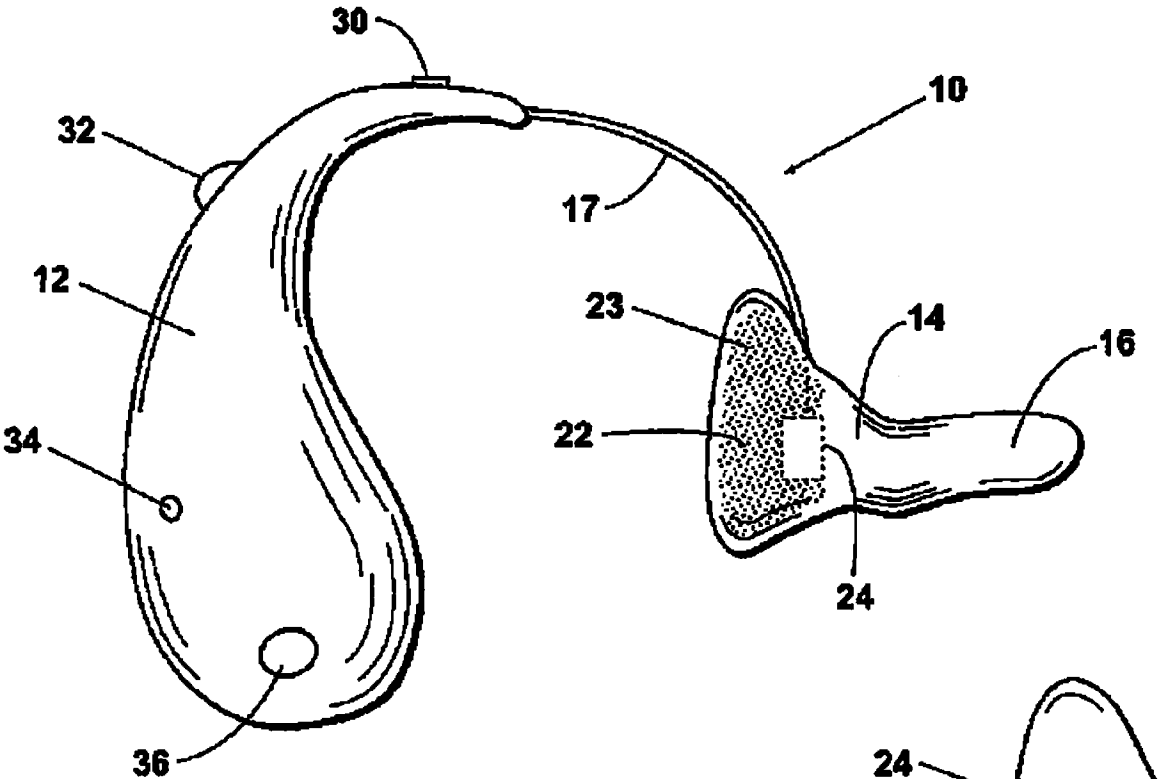
FIG. 1 is a side view of a bone conduction hearing aid device.
Figure 2:
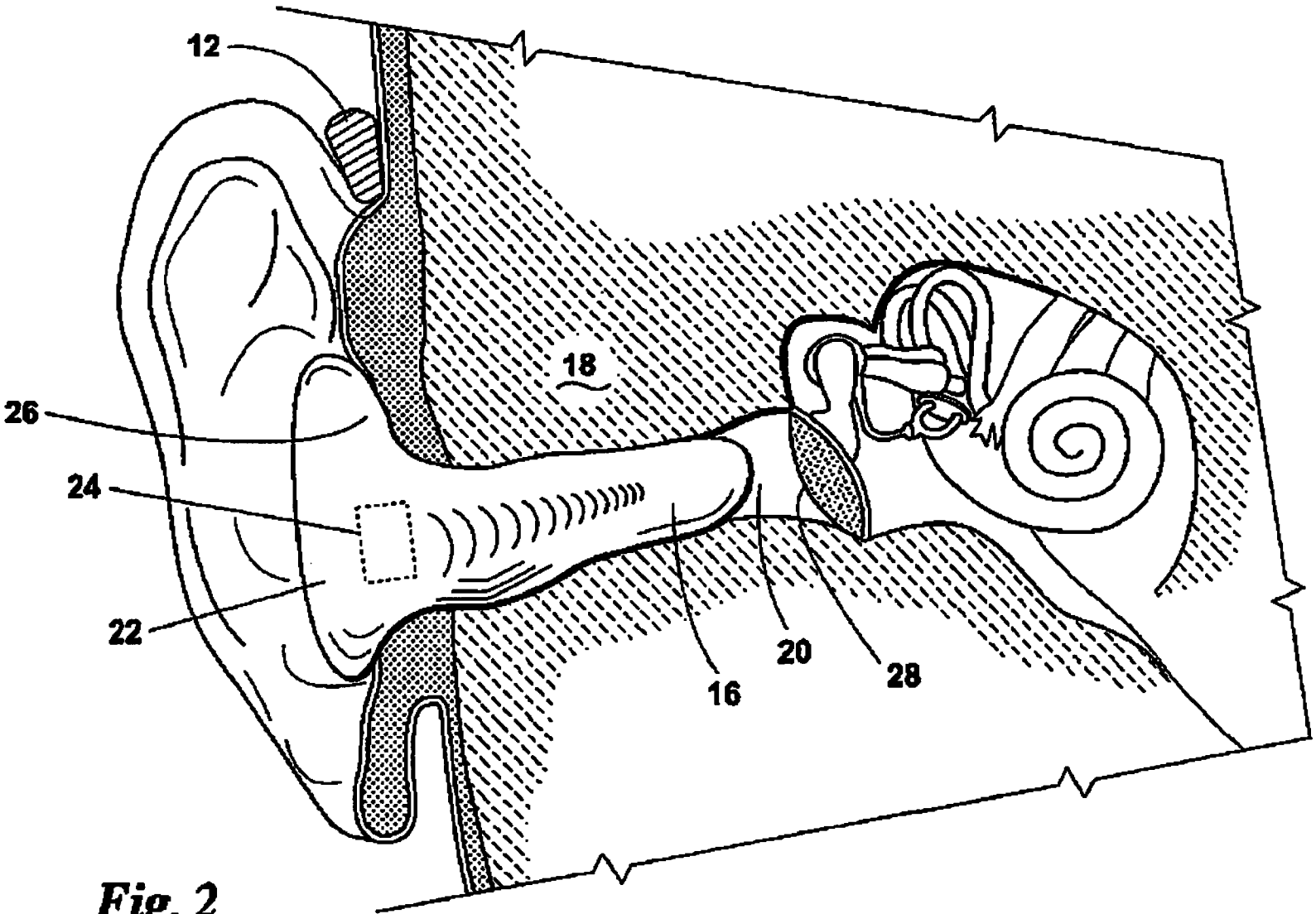
FIG. 2 is a sectional view of a patient wearing the hearing aid of FIG. 1.

Turning now to the drawings wherein like reference characters indicate like or similar parts throughout, FIGS. 1 and 2 illustrate a bone conduction hearing aid 10 in accordance with the invention. The hearing aid 10 preferably includes a behind-the-ear (BTE) member 12 for carrying elements needed to receive and process acoustic vibrations, and an in-the-ear (ITE) member 14 configured to receive signals processed by the BTE member 12 and convert those signals to corresponding vibrations that are conducted by the mastoid bone to a cochlea of the patient or user. BTE member 12 is in electronic communication with ITE member 14.

In a preferred embodiment as shown in FIG. 1, the two members 12, 14 are connected by an electrical cable assembly 17. Further details regarding a preferred embodiment of the cable assembly 17 are provided hereinafter. As an alternative to the wired assembly shown in FIG. 1, the BTE member 12 may include a radio frequency transmitter that wirelessly transmits processed signals to a receiver in the ITE member 14.

With continued reference to FIGS. 1 and 2, ITE member 14 includes an insertion portion 16 for being inserted into the user's ear canal adjacent the mastoid bone 18. Insertion portion 16 is preferably custom formed to closely fit the ear canal of the user, and FIG. 2 shows the hearing aid 10 fully inserted in the patient's ear canal 20. A non-insertion portion 22 adjacent to and connected with the insertion portion 16 is positioned in the concha 26 of the ear when the hearing aid 10 is in use. A non-surgically implanted vibrator 24 carried by (i.e., mounted on or in) the non-insertion portion 22 is in vibrational communication with the insertion portion 16. Vibrations produced by vibrator 24 are conducted by the insertion portion 16 to the mastoid bone 18. Thus, when insertion portion 16 is inserted in the ear canal 20, the vibrator 24 is positioned in the concha 26. This configuration is particularly advantageous for patients with ear canals that are too small to receive the vibrator 24, including patients with congenital atresia where the ear canal is extremely narrow or completely closed off from the tympanic membrane 28. For example, aural atresia occurs where there is an absence of the opening to the ear canal. Bony atresia occurs where there is a congenital blockage of the ear canal due to a wall of bone separating the ear canal from the middle ear space. For atresia patients, the concha 26 provides a location with sufficient space to receive the vibrator 24.

As mentioned above, BTE member 12 is configured to receive and process acoustic vibration signals and to provide the processed signals to ITE member 14 for operation of vibrator 24. External features of BTE member 12 shown in FIG. 1 include an acoustic vibration sensor, or microphone 30, for receiving acoustic vibration, and a volume control 32 for controlling the level of amplification provided by the hearing aid 10. An optional programming port 34 may be included which connects to a computer for adjusting programmable electronic parameters, such as feedback control, gain and maximum output. Access to the hearing aid battery 36 is also provided.

The insertion portion 16 of the hearing aid 10 is preferably formed from a vibrationally conductive material suitable for transferring vibration produced by the vibrator 24 into the ear canal 20 and then to the mastoid bone 18. Suitable materials include hard plastic, hard Lucite and acrylic. In a preferred embodiment, vibrator 24 is an electromechanical vibrator, such as a "moving coil" type. Piezoelectric and other vibrator types may also be employed in accordance with the invention.

In some embodiments, the vibrator 24 comprises an acoustic speaker or ear phone which generates acoustic vibrations within a wearer's ear canal 20.

Vibration produced by the vibrator 24 may be transferred through the cable 17 of the hearing aid 10 and picked up by the microphone 30, producing undesirable feedback particularly at higher amplifications. Feedback may be controlled by coating or otherwise fabricating non-insertion portion 22 with a vibration attenuating material 23, such as rubber. If electronic feedback reduction is desired, the programming port 34 is provided to enable adjustment of feedback control circuitry and other electro-acoustic parameters carried by BTE member 12.

In operation, sound waves are received by the microphone 30 and the microphone 30 outputs a corresponding microphone signal. The microphone signal is amplified and the amplified microphone signal is provided to the vibrator 24. Vibrations produced by the vibrator 24 are conducted by insertion portion 16 into the ear canal 20 and on to the mastoid bone 18, which in turn transfers the vibration to a cochlea of the user to enhance hearing perception. Thus, sound perception in patients with hearing loss is improved. Conducting vibration into the ear canal 20 in close proximity to the mastoid bone 18 provides excellent transfer of vibration to a cochlea by way of the mastoid bone 18.

The hearing aid 10 can function to improve hearing in either ear. For example, patients with conductive pathology in one ear can experience improved hearing perception by placing the hearing aid 10 in the ear with the conductive loss. Vibrations produced by the vibrator 24 are transferred by way of the mastoid bone 18 to the cochlea of the affected ear. The hearing aid 10 can also be used by patients with total loss of hearing in one ear. For such patients, the hearing aid 10 operates to transmit vibration output by vibrator 24 transcranially through the mastoid bone 18 from the bad ear to the good ear. Transcranial conduction of the vibrator output in this manner overcomes problems associated with the "head shadow" effect where sounds coming from the direction of the deaf ear are attenuated by the patient's head.

Figure 3:
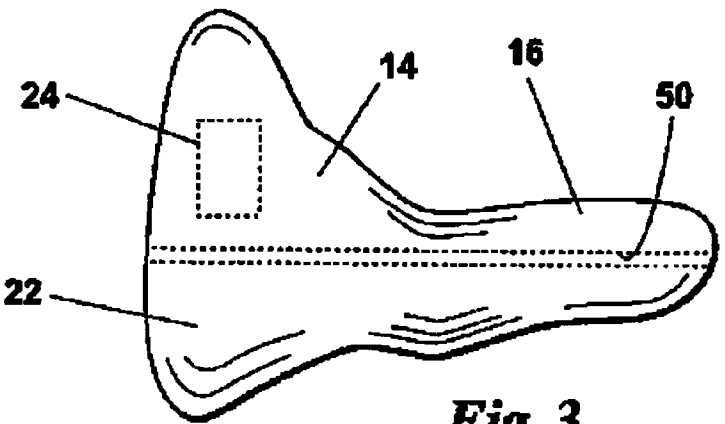
FIG. 3 is a side view of a vented in-the-ear member of a hearing aid device.

The hearing aid 10 can also be used to help patients that have certain conductive pathologies involving drainage from the ear. To enable the ear to properly drain, an ITE type hearing aid should be vented. Due to space constraints, it is very difficult to fabricate a bone conducting ITE hearing aid with a vent and a vibrator positioned in the ear canal. FIG. 3 shows how ITE member 16 can be configured to assist patients with such conductive pathologies. A vent 50 is provided to enable air to enter the ear canal for proper drainage of the ear. Vibrator 24 is located on or in non-insertion portion 22 where space is not as limited as in insertion portion 16. This configuration of ITE member 14 provides a treatment solution that was previously unavailable to patients with conductive pathologies that involve drainage of the ear.

The hearing aid 10 can even be used to improve hearing perception in individuals with no hearing loss in either ear. In extremely noisy environments, the hearing aid 10 can function both as a plug and as a filter which electronically filters the noise while allowing desired sound to be perceived. For example, aircraft maintenance personnel are commonly required to work in close proximity to aircraft while the engines are turning. Good communication among the maintenance crew is essential from a safety standpoint as well as to ensure the aircraft is in proper working condition. A hearing aid in accordance with the invention would be particularly useful in this type of noisy environment since it would block aircraft noise by acting as a plug, electronically filter the engines' higher frequency noise components, and still allow the lower frequency human voice to be sensed and perceived by the user.

Figure 4:
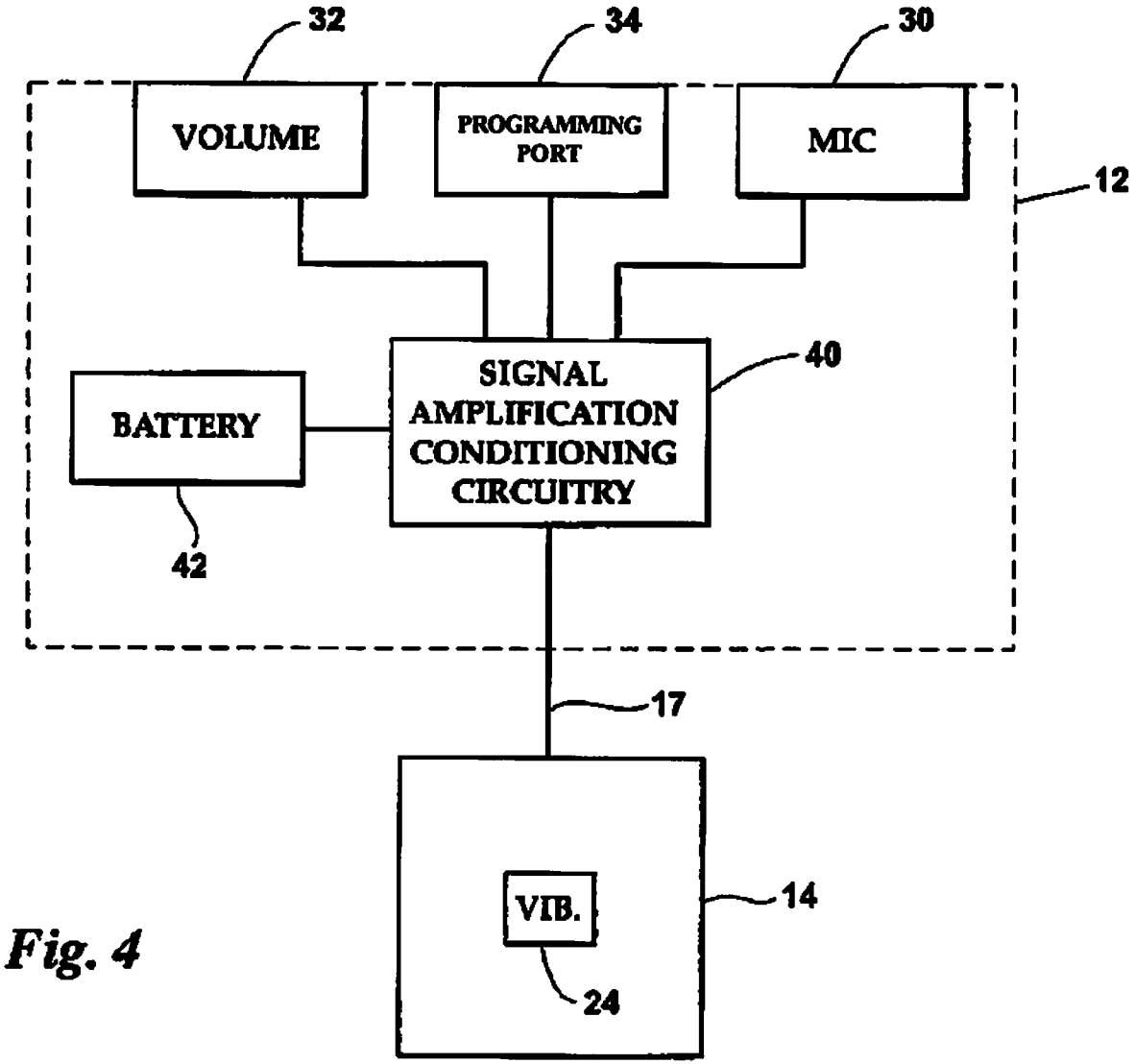
FIG. 4 is a functional block diagram of a hearing aid device.

A functional block diagram of a hearing aid 10 according to the invention is shown in FIG. 4. Sound waves are received by the microphone 30 which outputs a microphone signal to the signal amplification circuitry 40. The microphone signal is amplified by an amplifier within the signal amplification circuitry 40 and the amplified signal is sent to the vibrator 24 which produces vibrations corresponding to the amplified microphone signal. Electrical power is provided by a battery 42. The level of amplification can be adjusted with the volume control 32.

FIGS. 5A-5E depict a preferred embodiment of the cable assembly 17 that provides electrical communication between the ITE member 14 and the BTE member 12. In this embodiment, the cable assembly 17 comprises a highly-flexible cable portion 60 of length L having a first connector 52 at one end and a second connector 54 at the opposing end. In an exemplary embodiment, the first and second connectors 52 and 54 are manufactured by Plastics One, Inc. under model numbers 871 and 870, respectively. The cable portion 60 preferably comprises three wires twisted about each other and enclosed within an outer jacket. The three wires are electrically connected at their opposing ends to corresponding contacts 58*a*, 58*b* and 58*c* in the first connector 52 and contacts 56*a*, 56*b* and 56*c* in the second connector 54. (See FIGS. 5B and 5C.) As discussed in more detail below, the stiffness and vibration transmission characteristics of the cable portion 60 are determined by the structure and materials of the individual wires and the jacket that encloses the wires.

In a most preferred embodiment, the length L of the cable portion 60 is about 0.9 inch to about 1.4 inch. However, it will be appreciated that the invention is not limited to any particular length L of the cable portion 60.

Figure 5A:
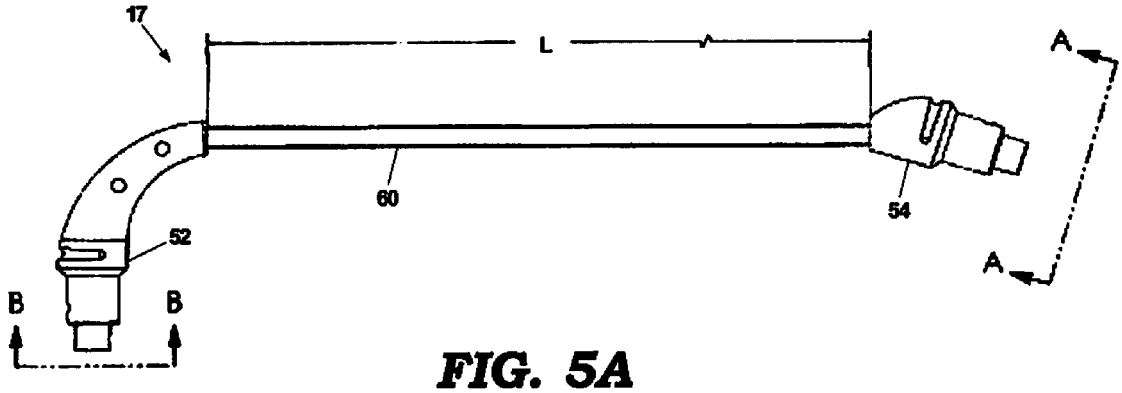
FIG. 5 depicts an electrical cable assembly for connecting an in-the-ear component to a behind-the-ear component of a hearing aid device according to a preferred embodiment of the invention.
Figure 5B:
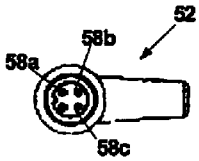
Figure 5C:
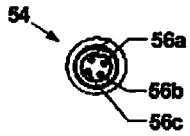
Figure 5D:
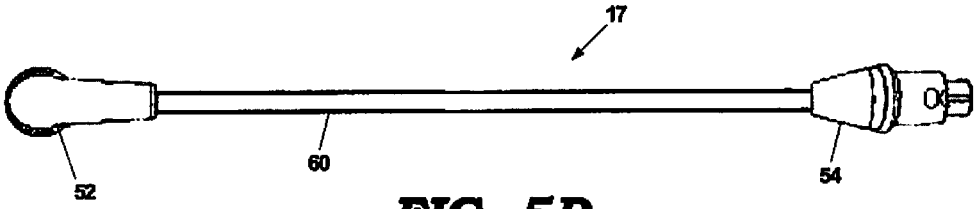
Figure 5E:
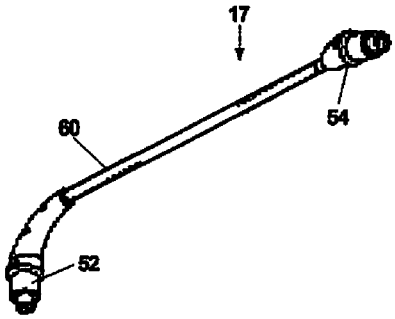

Although the cable portion 60 is depicted in FIGS. 5A, 5D and 5E, as straight when in use, the cable portion 60 may take on any shape as necessary to connect the ITE member 14 to the BTE member 12. Also, although the connectors 52 and 54 are depicted as having a particular angular orientation with respect to the cable portion 60, the connectors 52 and 54 may have any orientation with respect to the cable portion 60 as may be necessary to accommodate the connection of the connectors 52 and 54 to the ITE member 14 and the BTE member 12. Thus, it will be appreciated that the invention is not limited to any particular shape of the cable portion 60 or any particular orientation of the connectors 52 and 54 with respect to the cable portion 60.

In one preferred embodiment of the invention, each of the three wires comprising the cable portion is formed by weaving or braiding together multiple conductors that are each individually insulated by a polymer film. This type of wire construction is known in the art as "Litz" wire, which is derived from a German word (litzendraht) which means "woven wire." In a most preferred embodiment, each of the three Litz wires comprising the cable portion 60 includes eight strands of 46 gauge wire, which results in a 38 gauge assembly. New England Wire Technologies Corporation is one manufacturer of such Litz wire cable assemblies. Although Litz wire is used in a preferred embodiment, other types of highly flexible wire could be used, such as tinsel wire or stranded copper wire.

In addition to the construction of the wires, the construction of the protective jacket enclosing the wires also affects the vibration transmission characteristics of the cable portion 60. In the preferred embodiment, the protective jacket is formed of a relatively soft plastic which is molded around the wires in an extrusion process. This process leaves no air gaps between the wires and the jacket material. Such structure provides significantly better vibration dampening properties as compared to prior cable assembly structures which incorporated tubular sleeve jackets.

The woven wire construction of the conductors of the cable portion 60 provides a flexible structure that minimizes or dampens conduction of vibrations along the length of the cable assembly 17. Eliminating—or at least significantly reducing—vibration conduction along the cable assembly 17 is key to reducing the unwanted feedback of vibrations from the ITE member 14 to the BTE member 12. This advantage of the cable assembly 17 is particularly important in bone conduction hearing aid systems which generally present a more significant feedback problem along the interconnecting cable than do air conduction hearing aid systems. However, the vibration dampening properties of the cable assembly 17 are also advantageous in air conduction systems. Accordingly, it should be appreciated that the invention is not limited to any particular type of hearing aid system.

In preferred embodiments of the invention, cable portion 60 is highly flexible, having a Taber stiffness value of no more than about 7.0 Taber stiffness units, where the Taber stiffness value is determined as discussed below. In a most preferred embodiment, the stiffness of the cable portion 60 is less than 1.0 Taber stiffness unit. For example, the embodiment of the cable assembly 17 described above which has woven wire in the cable portion 60 has a Taber stiffness of 0.72 Taber stiffness units. By comparison, prior connector cables for connecting the ITE portion to the BTE portion of hearing aid devices have had Taber stiffness values of greater than 7.0 Taber stiffness units.

Figure 6A:
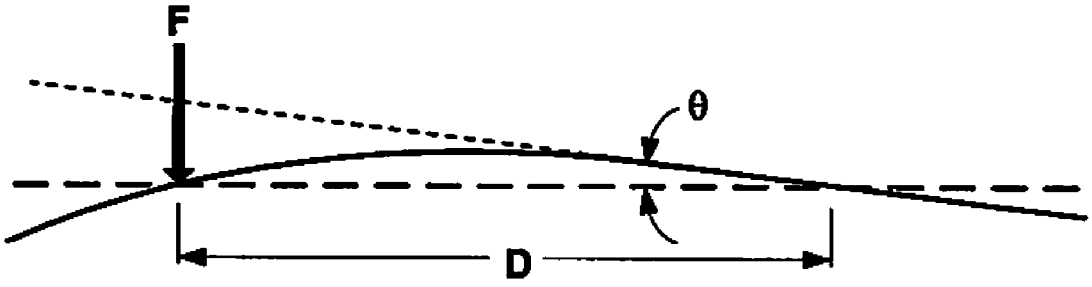
FIG. 6A depicts the geometry of a Taber stiffness test for determining stiffness of a material.
Figure 6B:
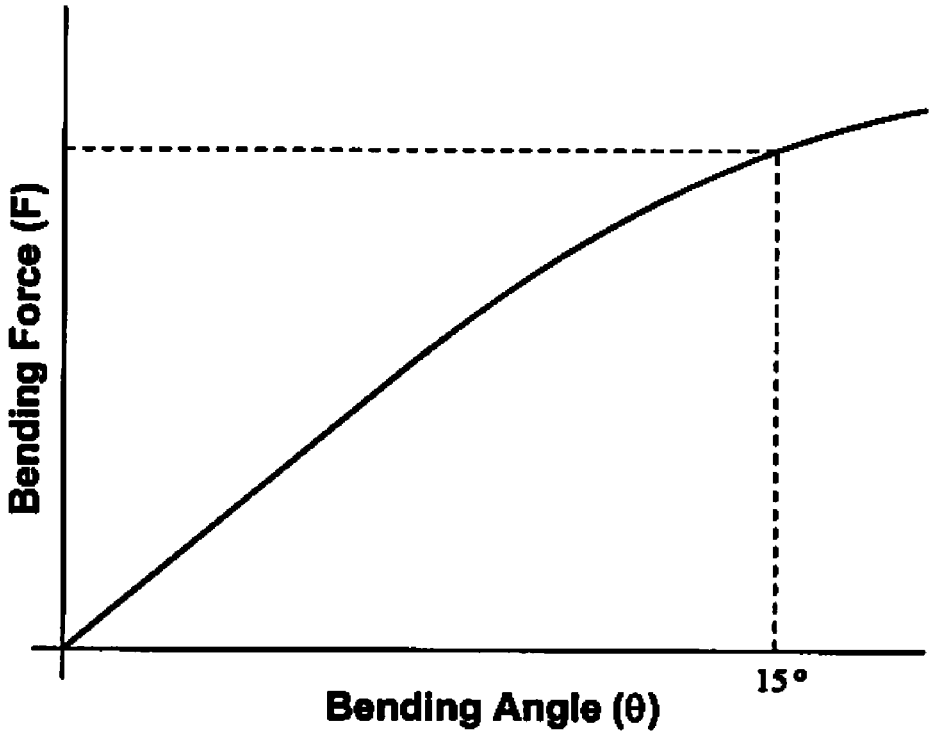
FIG. 6B depicts a graph of bending angle versus bending resistance for a Taber stiffness test.

According to industry standards, Taber stiffness of a specimen is determined by applying a bending force F to the specimen at a known distance D from a clamping point and measuring how much force F is required to bend the specimen to a particular angle θ, such as 15 degrees. The measurement geometry is depicted in FIG. 6A. Generally, stiffness of a specimen may be expressed by the relationship between the bending force F and the bending angle θ, as shown in FIG. 6B. The slope of the curve in FIG. 6B is the bending stiffness.

Taber stiffness of a specimen may be determined using a stiffness tester such as the Model 150-E manufactured by Taber Industries, which outputs stiffness in Taber stiffness units (g·cm). Generally, such stiffness testers include a pendulum weighing system for determining the force F. With the specimen held in a specimen clamp at the center of rotation of the pendulum, force is applied to the lower end of the specimen by a pair of rollers. The rollers, which are attached to a driving disc located directly behind the pendulum, push against the specimen and deflect it from its initial vertical position. The pendulum applies increasing torque to the specimen as it deflects further from its initial position. The test point reading occurs when the pendulum is moved to a particular angle θ, such as 15°, relative to its original position. The stiffness value is then read from a dial pointer on the tester, or from a digital read-out on the tester.

It will be appreciated that the method described above is but one way to determine stiffness of a material. Other test methods may be used to determine stiffness, and the invention is not limited to any particular test method or unit of stiffness measurement. For example, stiffness may also be expressed in Gurley stiffness units, where the relationship between Taber units and Gurley units are set forth in industry-standard TAPPI Test Methods T543 and T489.

As discussed above, one preferred embodiment of the invention incorporates so-called "Litz" wire construction to provide reduced stiffness. However, it will be appreciated that other cable construction techniques may be used to provide low stiffness in the range discussed above. Thus, it will be appreciated that the invention is not limited to any particular type of wire or means for constructing the wire or cable.

Figure 7:
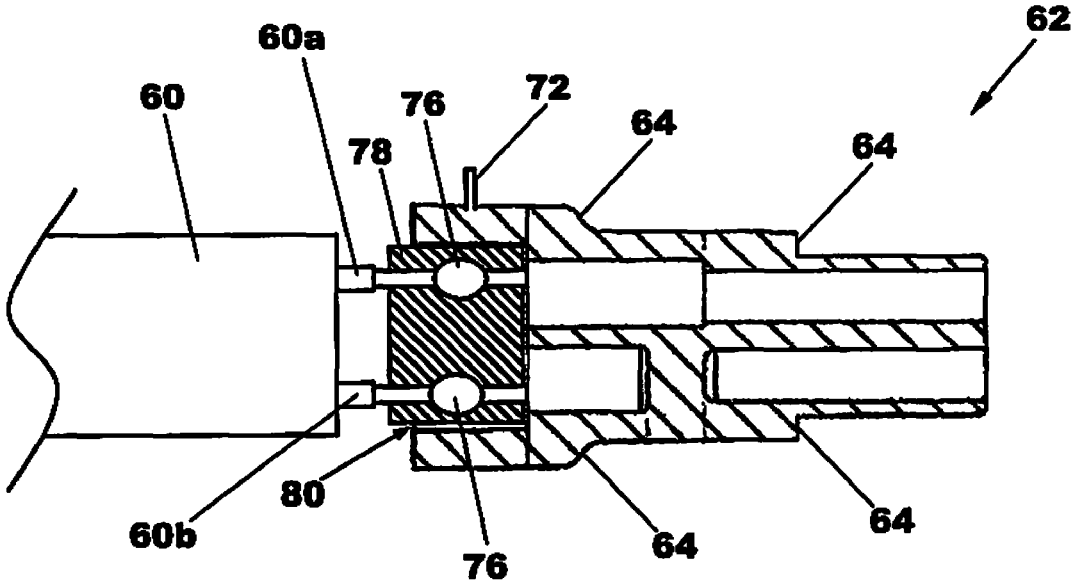
FIG. 7 is a partial cross-section view of a connector housing of an electrical cable assembly for connecting an in-the-ear component to a behind-the-ear component of a hearing aid device according to a preferred embodiment of the invention.
Figure 8:
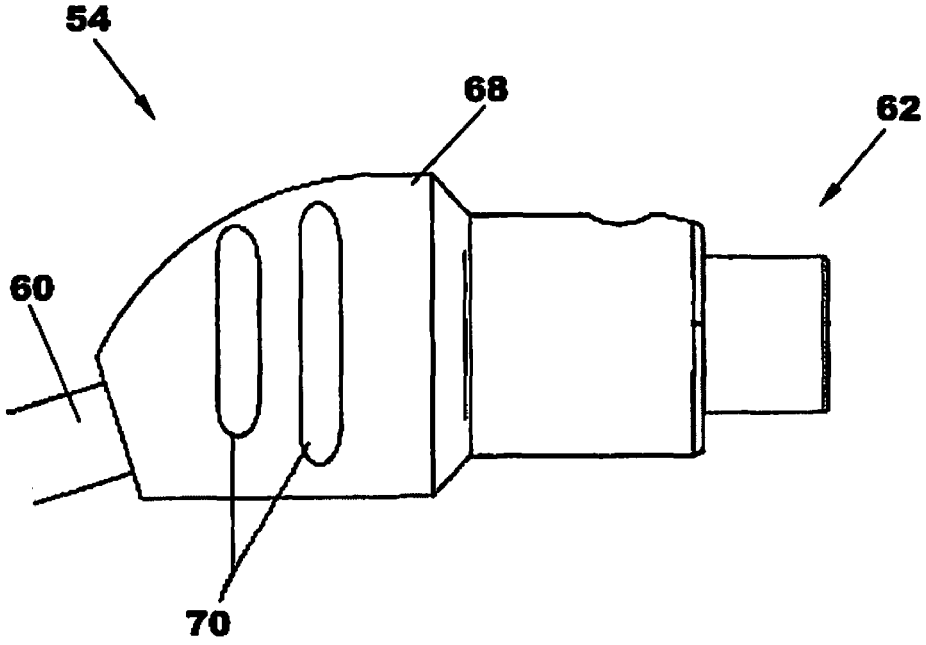
FIG. 8 is a side view of a connector assembly of an electrical cable assembly for connecting an in-the-ear component to a behind-the-ear component of a hearing aid device according to a preferred embodiment of the invention.
Figure 9:
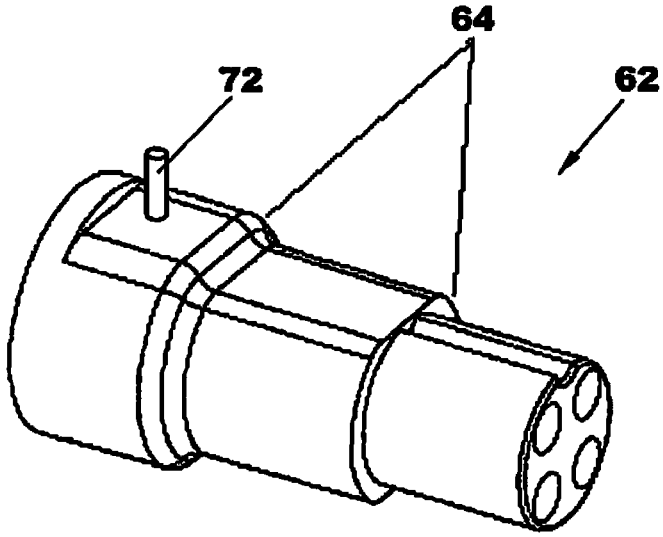
FIG. 9 is a perspective view of a connector housing of an electrical cable assembly for connecting an in-the-ear component to a behind-the-ear component of a hearing aid device according to a preferred embodiment of the invention.
Figure 10:
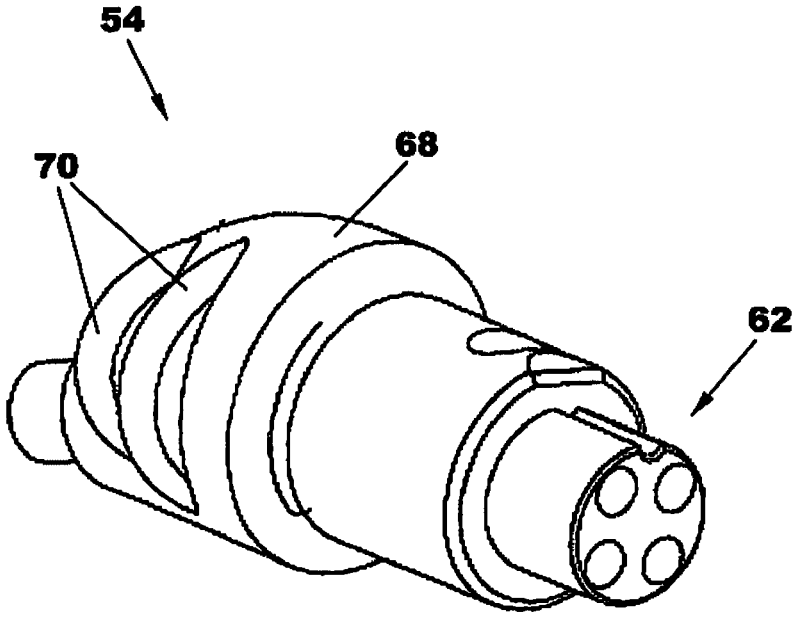
FIG. 10 is a perspective view of a connector assembly of an electrical cable assembly for connecting an in-the-ear component to a behind-the-ear component of a hearing aid device according to a preferred embodiment of the invention.
Figure 11:
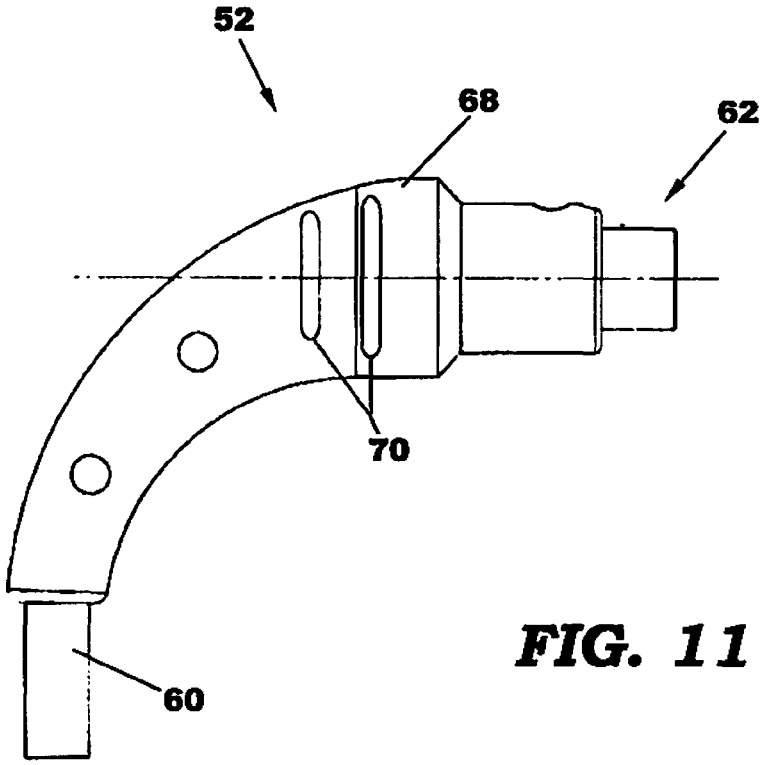
FIG. 11 is a side view of a connector assembly of an electrical cable assembly for connecting an in-the-ear component to a behind-the-ear component of a hearing aid device according to a preferred embodiment of the invention.
Figure 12:
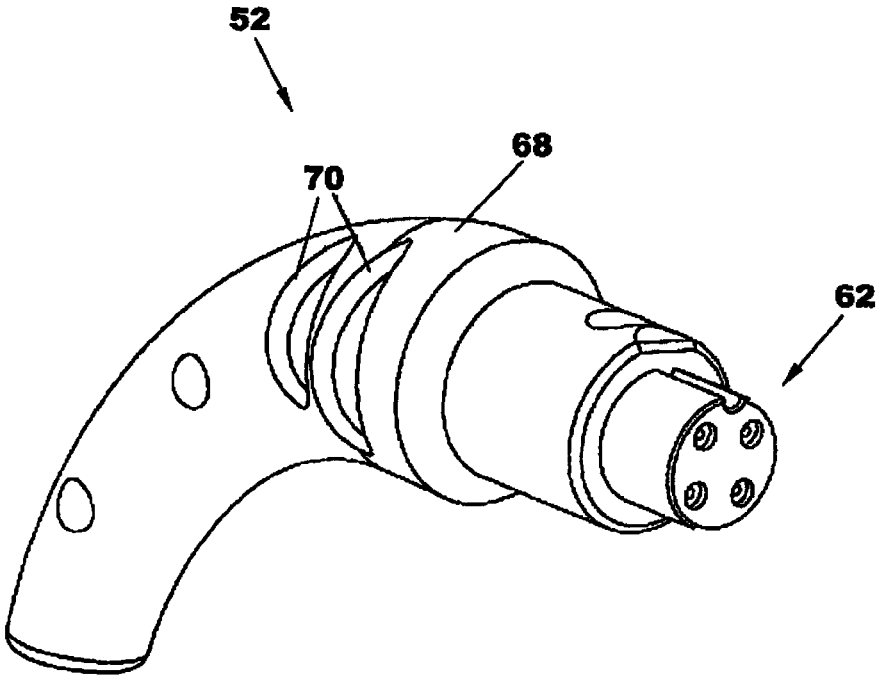
FIG. 12 is a perspective view of a connector assembly of an electrical cable assembly for connecting an in-the-ear component to a behind-the-ear component of a hearing aid device according to a preferred embodiment of the invention.

In a preferred embodiment of the invention, each of the connectors 52 and 54 comprise an inner connector housing and an outer connector shell which is over-molded onto the inner connector housing in an injection molding process. An example of the inner connector housing 62 is depicted in FIGS. 7 and 9. FIGS. 8 and 10-12 depict examples of the inner connector housing 62 at least partially encased in the over-molded outer connector shell 68. In one preferred embodiment, the inner connector housing 62 is formed of glass-filled nylon, and the outer connector shell 68 is formed of thermoplastic polyester elastomer (TPE).

As shown in the partial cross-section view of FIG. 7, the inner connector housing 62 has a rear cavity 80. Disposed within this cavity 80 are solder joints 76 which connect the wires of the cable portion 60 to the connector contacts of the inner connector housing. Although FIG. 7 depicts only two wires 60*a* and 60*b*, it will be appreciated that more than two wires may be accommodated within the cavity 80. The solder joints 76 are encased within a potting material 78 which substantially fills the cavity 80. In a preferred embodiment, the potting material 78 is UV-curable acrylic. The encasement of the solder joints 76 in the potting material 78 relieves stress from the solder joints 76 and prevents breakage. Based on pull tests, it has been determined that encasement of the solder joints 76 in the potting material 78 has increased the pull force required to cause breakage of the cable assembly 17 by 115%. In this configuration, breakage due to pull force occurs in the cable portion 60 rather than at the solder joints 76.

As shown in FIGS. 7 and 9, the inner connector housing 62 includes a series of stepped retention features 64 on its outer surface. These retention features 64 prevent the over-molded outer connector shell 68 from slipping backward with respect to the inner connector housing 62 when a rearward pulling force is applied to the outer connector shell 68. In a preferred embodiment, a retention pin 72 is also provided to enhance retention of the outer connector shell 68. The retention pin 72, which may be molded as part of the inner connector housing 62, preferably extends substantially into or through the outer connector shell 68.

As shown in FIGS. 8 and 10-12, winged finger grips 70 are integrated into the over-molded outer connector shell 68. These grips 70 provide a location for a user to grip the connector assemblies 52 and 54 when pulling them to disconnect the cable assembly 17 from the BTE member 12 or the ITE member 14. Preferably, the grips 70 are located above the largest section of the inner connector housing 62 to provide a more rigid point for grasping.

The foregoing description of preferred embodiments for this invention have been presented for purposes of illustration and description. They are not intended to be exhaustive or to limit the invention to the precise form disclosed. Obvious modifications or variations are possible in light of the above teachings. The embodiments are chosen and described in an effort to provide the best illustrations of the principles of the invention and its practical application, and to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. An electronic hearing aid apparatus comprising:

a first component including a vibration sensor for sensing acoustic vibrations and generating a vibration signal based on the sensed acoustic vibrations, electronics for processing and amplifying the vibration signal to generate an amplified vibration signal, and an output port for providing access to the amplified vibration signal;

a second component including an input port for receiving the amplified vibration signal and a vibration generator for generating vibrations based on the amplified vibration signal; and a cable assembly for electrically connecting the first component to the second component and for conducting the amplified vibration signal from the output port of the first component to the input port of the second component, the cable assembly including:

a first connector for electrically connecting to the output port of the first component;

a second connector for electrically connecting to the input port of the second component; and a flexible cable portion including a plurality of wires for electrically connecting the first connector to the second connector, the first and second connectors each including:

an inner connector housing having:

a plurality of electrical contacts for conducting the amplified vibration signal;

a rear cavity formed in the inner connector housing;

a plurality of solder joints disposed within the rear cavity, the solder joints providing electrical connection between the electrical contacts and the wires of the flexible cable portion; and potting material disposed in the rear cavity and encasing the solder joints; and an outer connector shell encasing at least a portion of the inner connector housing and at least a portion of the flexible cable portion connected to the inner connector housing.

2. The hearing aid apparatus of claim 1 wherein the first component is contained in a housing configured to be worn behind the ear of a user of the hearing aid apparatus.

3. The hearing aid apparatus of claim 1 wherein the second component is contained in a housing configured to be worn in the ear of a user of the hearing aid apparatus.

4. The hearing aid apparatus of claim 1 wherein the vibration generator of the second component comprises a bone-conduction vibrator configured to produce vibrations that are conducted by the second component to the mastoid bone of a user of the hearing aid apparatus.

5. The hearing aid apparatus of claim 1 wherein the vibration generator of the second component comprises a receiver configured to produce airborne vibrations within an ear canal of a user of the hearing aid apparatus.

6. The hearing aid apparatus of claim 1 wherein the cable portion of the cable assembly has a stiffness of no more than about 7.0 Taber stiffness units.

7. The hearing aid apparatus of claim 1 wherein the cable portion of the cable assembly comprises one or more woven wires.

8. The hearing aid apparatus of claim 1 wherein the cable portion of the cable assembly comprises one or more Litz wires.

9. A cable assembly for use in connecting first and second components of an electronic hearing aid apparatus, wherein the first component includes a vibration sensor for sensing acoustic vibrations and generating a vibration signal based on the sensed acoustic vibrations, electronics for processing and amplifying the vibration signal to generate an amplified vibration signal, and an output port for providing access to the amplified vibration signal, and wherein the second component includes an input port for receiving the amplified vibration signal and a vibration generator for generating vibrations based on the amplified vibration signal, the cable assembly for electrically connecting the first component to the second component and for conducting the amplified vibration signal from the output port of the first component to the input port of the second component, the cable assembly comprising:

a first connector for electrically connecting to the output port of the first component;

a second connector for electrically connecting to the input port of the second component; and a flexible cable portion including a plurality of wires for electrically connecting the first connector to the second connector, the first and second connectors each including:

an inner connector housing having:

a plurality of electrical contacts for conducting the amplified vibration signal;

a rear cavity formed in the inner connector housing;

a plurality of solder joints disposed within the rear cavity, the solder joints providing electrical connection between the electrical contacts and the wires of the flexible cable portion; and potting material disposed in the rear cavity and encasing the solder joints; and an outer connector shell encasing at least a portion of the inner connector housing and at least a portion of the flexible cable portion connected to the inner connector housing.

10. The cable assembly of claim 9 wherein inner connector housing includes retention features on its outer surface, which features prevent the outer connector shell from slipping with respect to the inner connector housing when a pulling force is applied to the outer connector shell.

11. The cable assembly of claim 10 wherein the retention features include steps provided in the outer surface of the inner connector housing.

12. The cable assembly of claim 10 wherein the retention features include a retention pin extending from the outer surface of the inner connector housing.

13. The cable assembly of claim 9 wherein the outer connector shell is formed by over-molding onto the inner connector housing.

14. The cable assembly of claim 9 further comprising a plurality of grip features formed in an outer surface of the outer connector shell.

15. A cable assembly for use in connecting first and second components of an electronic hearing aid apparatus, wherein the first component includes a vibration sensor for sensing acoustic vibrations and generating a vibration signal based on the sensed acoustic vibrations, electronics for processing and amplifying the vibration signal to generate an amplified vibration signal, and an output port for providing access to the amplified vibration signal, and wherein the second component includes an input port for receiving the amplified vibration signal and a vibration generator for generating vibrations based on the amplified vibration signal, the cable assembly for electrically connecting the first component to the second component and for conducting the amplified vibration signal from the output port of the first component to the input port of the second component, the cable assembly comprising:

a first connector for electrically connecting to the output port of the first component;

a second connector for electrically connecting to the input port of the second component; and a flexible cable portion including a plurality of wires for electrically connecting the first connector to the second connector, the first and second connectors each including:

an inner connector housing having:

a plurality of electrical contacts for conducting the amplified vibration signal;

a rear cavity formed in the inner connector housing;

a plurality of solder joints disposed within the rear cavity, the solder joints providing electrical connection between the electrical contacts and the wires of the flexible cable portion; and potting material disposed in the rear cavity and encasing the solder joints; and an outer connector shell formed by over-molding onto the inner connector housing, the outer connector shell encasing at least a portion of the inner connector housing and at least a portion of the flexible cable portion connected to the inner connector housing, the outer connector shell having a plurality of grip features formed in an outer surface of the outer connector shell, wherein the inner connector housing includes retention features which prevent the outer connector shell from slipping with respect to the inner connector housing when a pulling force is applied to the outer connector shell.

* * * * *